US007621006B1

(12) United States Patent
Tucker

(10) Patent No.: US 7,621,006 B1
(45) **Date of Patent: *Nov. 24, 2009**

(54) BEDDING ACCESSORY FOR ARTICLE STORAGE

(75) Inventor: Holly S. Tucker, Hendersonville, NC (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/238,302

(22) Filed: Sep. 25, 2008

Related U.S. Application Data

(63) Continuation of application No. 11/901,256, filed on Sep. 14, 2007.

(51) Int. Cl.
*A47G 9/02* (2006.01)
*A47G 11/00* (2006.01)

(52) U.S. Cl. ..... 5/493; 5/485; D6/603; 108/90

(58) Field of Classification Search ..... 5/493, 5/485, 503.1, 659; 297/188.2; 108/90; D6/596, D6/603

See application file for complete search history.

(56) References Cited

U.S. PATENT DOCUMENTS

| | | | | |
|---|---|---|---|---|
| 2,359,372 | A | 10/1944 | Leader | |
| 2,532,517 | A | 12/1950 | Schwartzman et al. | |
| 2,641,001 | A | 6/1953 | Krasnov | |
| 2,763,875 | A | 9/1956 | Piontkowski | |
| 4,131,313 | A * | 12/1978 | Jacobs | 297/188.2 |
| 4,309,784 | A * | 1/1982 | Cohen | 5/639 |
| 4,585,127 | A | 4/1986 | Benedict | |
| 4,686,726 | A | 8/1987 | Dunfee | |
| D314,304 | S | 2/1991 | Levine | |
| 5,271,112 | A | 12/1993 | Bible et al. | |
| 5,279,009 | A | 1/1994 | Putka, Jr. | |
| 5,581,829 | A | 12/1996 | Lee | |
| 5,733,397 | A | 3/1998 | McDaniel | |
| 5,737,785 | A * | 4/1998 | Casey | 5/419 |
| 5,758,972 | A | 6/1998 | Mack et al. | |
| D409,873 | S * | 5/1999 | Johnson | D6/603 |

(Continued)

OTHER PUBLICATIONS

Information Disclosure Statement (IDS) Letter Regarding Common Patent Application(s), submitted by Applicant on Jun. 10, 2009.

*Primary Examiner*—Michael Trettel
(74) *Attorney, Agent, or Firm*—Chad D. Tillman; James D. Wright; Tillman Wright, PLLC

(57) ABSTRACT

A bedding accessory for storing shoes at least partially in the space beneath a bed frame includes a sheet portion, side portions appended to an edge of the sheet portion, and storage compartments formed on the side portions. The sheet portion is placed in substantially covering relation to an upper surface of a mattress support structure. The side portions are arranged to hang downwardly from the sheet portion adjacent the space beneath the bed frame. Each storage compartment is configured to retain a shoe therein and is comprised of an outer panel facing outwardly away from the bed frame and an inner panel facing inwardly toward the space beneath the bed frame. The inner and outer panels of each storage compartment jointly define an opening for receipt of a shoe, and the compartment substantially retains the shoe at least partially in the space beneath the bed frame.

14 Claims, 2 Drawing Sheets

U.S. PATENT DOCUMENTS

| | | | | |
|---|---|---|---|---|
| D427,781 | S | 7/2000 | Rogman et al. | |
| D429,897 | S | 8/2000 | Rogman et al. | |
| 6,151,731 | A | 11/2000 | Saparow | |
| 6,349,491 | B1 | 2/2002 | Able | |
| 6,390,715 | B1 | 5/2002 | Gerbasi | |
| 6,431,418 | B1 | 8/2002 | Pease | |
| 6,508,183 | B2 * | 1/2003 | Kerrigan | 108/90 |
| D471,049 | S * | 3/2003 | Dale | D6/596 |
| 6,594,836 | B1 | 7/2003 | Everson et al. | |
| 6,601,250 | B1 | 8/2003 | Taylor | |
| 6,626,491 | B1 * | 9/2003 | Blome et al. | 297/229 |
| D481,899 | S | 11/2003 | Thomas et al. | |
| 6,854,139 | B2 | 2/2005 | Lamy | |
| D546,613 | S | 7/2007 | OConnor | |
| 7,281,281 | B2 | 10/2007 | Langenberger | |
| D577,531 | S * | 9/2008 | Brown | D6/597 |
| 2005/0220370 | A1 | 10/2005 | Kohn et al. | |
| 2008/0222806 | A1 * | 9/2008 | Hart | 5/493 |
| 2009/0113629 | A1 | 5/2009 | Tucker | |

* cited by examiner

BEDDING ACCESSORY FOR ARTICLE STORAGE

CROSS-REFERENCE TO RELATED APPLICATION

The present application is a U.S. continuation patent application of, and claims priority under 35 U.S.C. §120 to, U.S. nonprovisional patent application Ser. No. 11/901,256, filed Sep. 14, 2007, and published as U.S. Patent Application Publication No. 2009/0113629 on May 7, 2009, which patent application and publication are incorporated by reference herein.

The present application also incorporates, by reference herein, U.S. design patent application Ser. No. 29/291,531, filed Sep. 4, 2007, and U.S. Design Pat. No. D587,055, which issued therefrom on Feb. 24, 2009.

BACKGROUND

In terms of storage, the space below a typical bed is one of the most under-utilized areas in the average home. There have been mechanical assemblies designed to utilize that space, but no one has provided a convenient bedding accessory to do so. Many designs for bedding are intended to occupy areas adjacent to the bed for storage, some near the floor, and others at mattress level.

A number of pocketed bed shams have been proposed. U.S. Pat. No. D481,899 provides an odd-looking tarp, which suggests that pockets would be useful on the exterior. But this design does not have the slack required to allow storage to rest underneath the bed. U.S. Pat. No. D471,049 depicts a dust ruffle with storage. Due to the excess of material, this storage will obstruct the floor area surrounding the bed, when it is occupied. Neither of these two designs, unfortunately, will function with a footboard, and neither will tend to utilize the space underneath the bed itself.

U.S. Pat. No. 5,279,009, No. 5,581,829, No. 6,594,836 and No. 6,601,250 all indicate pockets on the sides of a mattress, which take up otherwise useful space, while causing stored articles to actually become a hindrance to normal activities, such as sitting on the edge of the mattress.

Again, all of these items fail to effectively utilize the actual volume directly below the box-spring. More specifically, no bedding apparel prescribes a use to optimize its own material, and maximize storage capacity.

SUMMARY

The ShoeSkirt is a storage solution to those with limited closet space (or just too many shoes) because it takes the storage out of the closet and brings it into the bedroom—using the dead space already existing under your bed frame. This area has historically been under-utilized. The ShoeSkirt is mainly a woman's product for women's shoes. Men can appreciate it if they are married to women with too many shoes, though. The ShoeSkirt, however, can store things other than shoes.

Thus, it is an object of this invention to provide a pocketed bedskirt that utilizes a portion of the space directly under a bed, by having pockets that are pleated on the portion that is interior to the bedskirt.

It is another object of this invention to provide a pocketed bedskirt that is slotted, so that it functions on any bed, and not just beds without a footboard.

It is yet another object of this invention to provide a pocketed bedskirt that allows the contents in storage to be visible through the pocket material.

It is still another object of this invention to provide a pocketed bedskirt that maximizes the use of the bedskirt as an under-bed storage device, by utilizing the entire length of the exposed perimeter of the bed.

It is one more object of this invention to provide a pocketed bedskirt that has a clean uniform appearance upon its exterior. The invention provided disguises the bulk of the shoes, and gives a clean look under the decorative bed sham (or dust ruffle), providing hidden shoe storage under your bed frame.

DRAWING FIGURES

ITEM NUMBERS

10 SHOESKIRT
15 UPPER PORTION
20 SIDE
30 POCKET
40 OUTER PANEL
50 INNER PANEL
55 PLEAT
60 STITCHING
80 TABLE

DESCRIPTION

Figure 1:
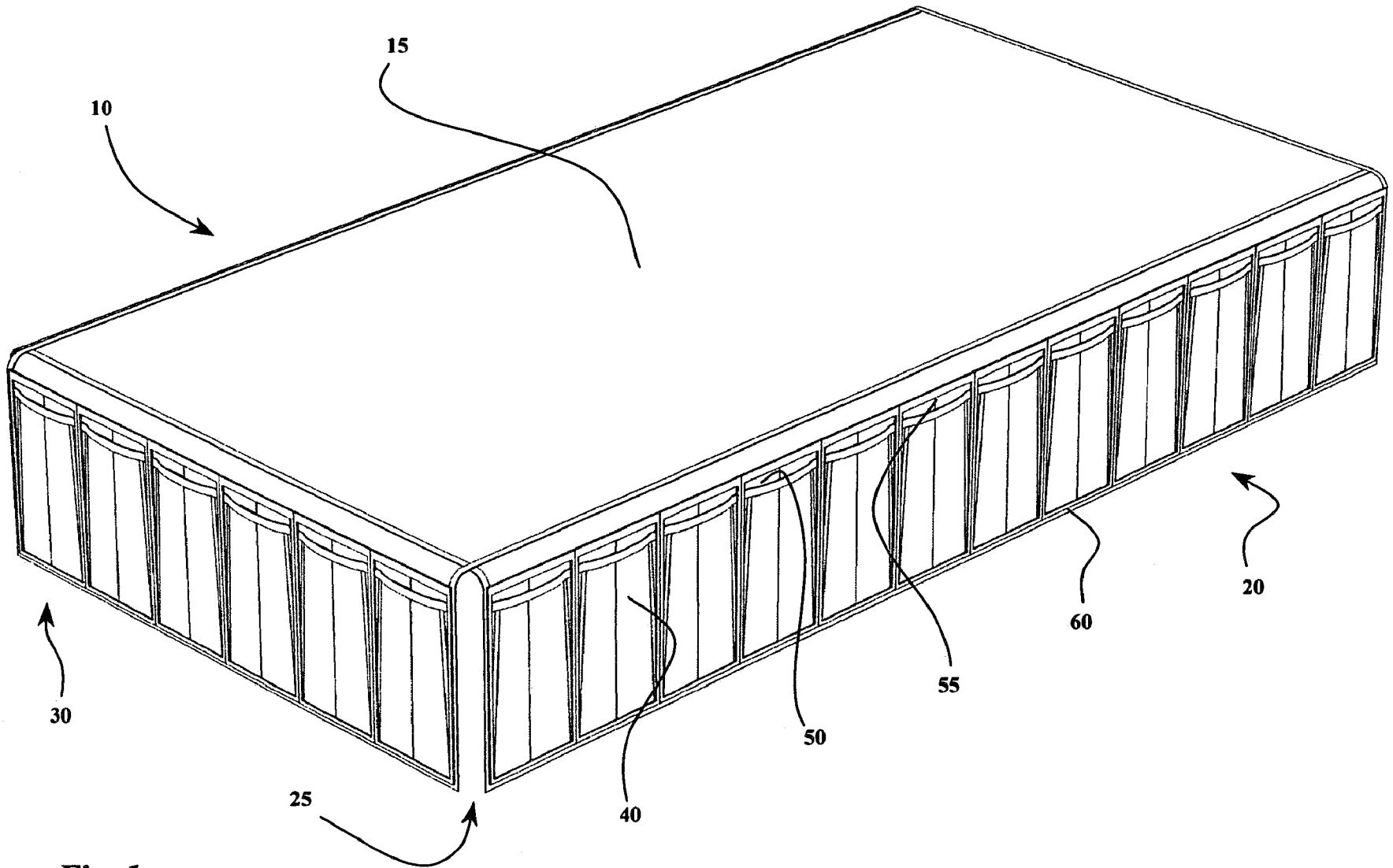
FIG. 1 is a perspective view of a Shoeskirt.

The device is a ShoeSkirt (shown in FIG. 1). It is made of a combination of sheet materials and stitching.

In its preferred embodiment, the ShoeSkirt 10 is designed to store shoes, one pair of shoes in each pouch (approximately thirty pairs of shoes on a twin-sized bed). It can also hold a variety of other items in each pocket 30.

The pockets themselves are designed so that the bulk of their contents is disposed underneath a bed, within a perimeter defined by the four sides of the box-spring. The construction of the ShoeSkirt facilitates this condition.

The upper portion 15 is attached to at least one draping side 20. The upper portion and the side(s) are made of an appropriate linen, a gathered material (such as polypropylene). Between two adjacent sides, a slot 25 is provided. This slot allows the ShoeSkirt to be used with beds of slight variation from nominal size, as well as with bed frames that include a footboard. Though, ShoeSkirts having different overall dimensions will be made to fit different standard bed sizes (i.e. King, Queen, Full, etc.).

The side comprises at least one inner panel 50 and one outer panel 40, in the form of a pouch. The inner and outer panels can be primarily transparent and made of a clear vinyl, or they can be made of a suitable fabric, or a combination of either. The inner panel has at least one pleat 55 to allow the pocket to expand toward the interior of the ShoeSkirt, and underneath the bed. The inner and outer panels are secured together with thread stitching 60, along their sides and bottom. The top edges of the panels remain unfastened to allow articles to be inserted and removed easily. The inner panel is stitched to the upper portion, to form the side 20 of the ShoeSkirt.

Figure 2:
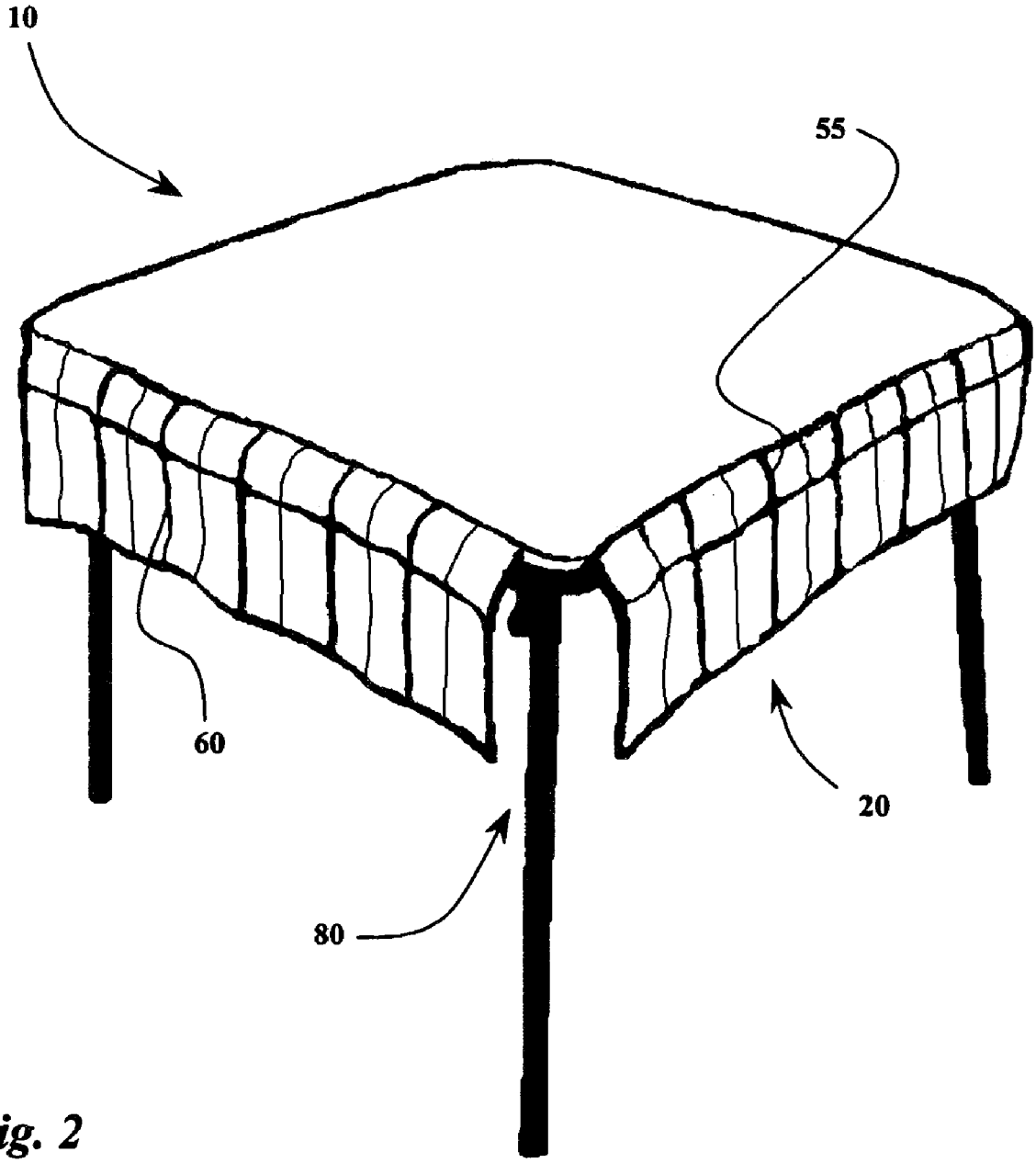
FIG. 2 is a perspective view of an alternate embodiment of the Shoeskirt (mounted on an ordinary collapsible craft table).

An alternate embodiment is also shown (FIG. 2). Here, the ShoeSkirt 10 is used as a table cover for hobbies and games, with at least one pocketed side 20 that hangs downward below the surface of the table 80. An example of a pleat 55 is shown, as well as an area of stitching 60.

Another embodiment is a TravelSkirt (not shown). This is a section of a ShoeSkirt that slips under the end of the bed to provide approximately 12 pockets of storage (for queen-size).

What is claimed is:

1. A bedding accessory for storing at least one shoe at least partially in the space beneath a bed frame, the bedding accessory comprising:

(a) a sheet portion having four side edges for placement in substantially covering relation to an upper surface of a mattress support structure;

(b) at least two separate side portions appended to corresponding side edges of the sheet portion and arranged to hang downwardly therefrom adjacent the space beneath the bed frame; and (c) one or more storage compartments formed on each of the side portions, each storage compartment being configured to at least substantially retain a pair of shoes therein;

(d) wherein each storage compartment is comprised of an outer panel facing outwardly away from the bed frame and an inner panel facing inwardly toward the space beneath the bed frame; and (e) wherein the inner and outer panels of each storage compartment jointly define an opening for receipt of a shoe;

(f) whereby, upon receipt of a shoe, the storage compartment substantially retains the shoe at least partially in the space beneath the bed frame.

2. The bedding accessory of claim 1, wherein the outer panel of each storage compartment is composed of a transparent material to permit the shoe retained in each storage compartment to be visible.

3. The bedding accessory of claim 1, wherein the inner and outer panels of each storage compartment are composed of a fabric material.

4. The bedding accessory of claim 1, wherein the inner panel of each storage compartment includes a pleat for permitting expansion of each storage compartment inwardly into the space beneath the bed frame.

5. The bedding accessory of claim 1, wherein one of the side portions is appended only to the edge of the sheet portion adjacent a foot area of the bed frame, whereby a pair of shoes received in each storage compartment is retained at least substantially in the space beneath the foot area of the bed frame.

6. The bedding accessory of claim 1, wherein the side portions are appended to the edges of the sheet portion adjacent lateral side areas of the bed frame, whereby a pair of shoes received in each storage compartment is retained at least substantially in the space beneath the lateral side areas of the bed frame.

7. The bedding accessory of claim 1, wherein the bedding accessory is configured for use with a bed frame that includes a footboard.

8. A bedding accessory for storing a plurality of articles at least substantially in the space beneath a bed frame, the bedding accessory comprising:

(a) a sheet portion having four side edges for placement in substantially covering relation to an upper surface of a mattress support structure;

(b) at least two separate side portions appended to corresponding side edges of the sheet portion and arranged to hang downwardly therefrom adjacent the space beneath the bed frame; and (c) one or more storage compartments formed on each of the side portions, each storage compartment being configured to at least substantially retain at least one article therein;

(d) wherein each storage compartment is comprised of an outer panel facing outwardly away from the bed frame and an inner panel facing inwardly toward the space beneath the bed frame, wherein, (i) the inner and outer panels of each storage compartment jointly define an opening for receipt of the article, and (ii) the outer panel of each storage compartment is composed of a transparent material to permit an article retained in each storage compartment to be visible;

(e) whereby, upon receipt of an article, the storage compartment substantially retains the article at least substantially in the space beneath the bed frame.

9. The bedding accessory of claim 8, wherein the inner panel of each storage compartment includes a pleat for permitting expansion of each storage compartment inwardly into the space beneath the bed frame.

10. The bedding accessory of claim 8, wherein one of the side portions is appended only to the edge of the sheet portion adjacent a foot area of the bed frame, whereby an article received in each storage compartment is retained at least substantially in the space beneath the foot area of the bed frame.

11. The bedding accessory of claim 8, wherein the side portions are appended to the edges of the sheet portion adjacent lateral side areas of the bed frame, whereby an article received in each storage compartment is retained at least substantially in the space beneath the lateral side areas of the bed frame.

12. The bedding accessory of claim 8, wherein each storage compartment is shaped such that the storage compartment is adapted to receive and store a pair of shoes.

13. The bedding accessory of claim 8, wherein the bedding accessory is configured for use with a bed frame that includes a footboard.

14. A method of using a bedding accessory for storing at least one shoe at least partially in the space beneath a bed frame, comprising:

(a) providing a bedding accessory having a sheet portion having four side edges, at least two separate side portions appended to corresponding side edges of the sheet portion, and one or more storage compartments formed on each side portion, each storage compartment being configured to at least substantially retain a shoe therein;

(b) arranging the sheet portion of the bedding accessory in substantially covering relation to an upper surface of a mattress support structure;

(c) arranging each side portion to hang downwardly from the mattress support structure adjacent the space beneath the bed frame; and (d) placing a shoe into a selected one of the storage compartments, whereby, upon receipt of the shoe, the storage compartment substantially retains the shoe at least partially in the space beneath the bed frame.

* * * * *